United States Patent [19]

Edelstein et al.

[11] 4,081,023

[45] Mar. 28, 1978

[54] HEAT PIPES TO USE HEAT FROM LIGHT FIXTURES

[75] Inventors: Fred Edelstein, Hauppauge; Robert A. Haslett, Dix Hills; Odd E. Sangesland, Plainview, all of N.Y.

[73] Assignee: Grumman Aerospace Corporation, Bethpage, N.Y.

[21] Appl. No.: 745,385

[22] Filed: Nov. 26, 1976

[51] Int. Cl.[2] ..... F28D 15/00

[52] U.S. Cl. ..... 165/53; 165/105; 165/DIG. 12; 362/218; 362/294; 362/345; 362/373

[58] Field of Search ..... 165/53, 105, DIG. 12; 240/47, 9

[56] References Cited

U.S. PATENT DOCUMENTS

| | | | |
|---|---|---|---|
| 3,112,890 | 12/1963 | Snelling | 240/47 X |
| 3,193,001 | 7/1965 | Meckler | 240/47 X |
| 3,666,005 | 5/1972 | Moore, Jr. | 165/105 |
| 3,967,385 | 7/1976 | Culbertson | 165/105 X |

FOREIGN PATENT DOCUMENTS

| | | | |
|---|---|---|---|
| 1,814,203 | 7/1970 | Germany | 240/47 |

*Primary Examiner*—Albert W. Davis, Jr.
*Attorney, Agent, or Firm*—Richard G. Geib; Mellor A. Gill

[57] ABSTRACT

A heat pipe to remove heat from a light fixture in a room of a building that will transfer the fixture heat to a system in a building that will in turn reject or use the fixture heat in a heating, ventilating, air conditioning system for the building.

4 Claims, 8 Drawing Figures

HEAT PIPES TO USE HEAT FROM LIGHT FIXTURES

BACKGROUND

As is well known, office buildings with the necessary lighting generate a considerable amount of heat that is not needed except for minimum reheat, or perhaps, during the coldest months of the year in the colder climes of the world. It has been found that as much as 50% of the heat load in office buildings is from their light fixtures. Also well known is that the majority of the heat generated in any building due to all sources including light fixtures is in the building core and very little at the perimeter where external wall exposure creates temperature fluctuations that must be accommodated.

Some prior art suggestions have been noted to remove light fixture heat such as are disclosed by U.S. Pat. Nos. 3,090,434; 3,424,233 and 3,507,320 where there is continuously circulated through passages or a chamber between dual walled light fixtures a fluid, typically water. Such suggestions add installation problems in requiring in addition to an electrician a skilled plumber to install and work on a light fixture to say nothing of the service life cycle and safety problems arising by reasons of leaks in the electric fixtures from the many plumbing connections that could arise even with the best of skilled maintenance over time.

FIELD OF INVENTION

It is in the solution of these problems in providing a heat pipe for a light fixture that with a heat exchange connection to a fluid circulating system provides control of environment of the area for the light fixture that this invention is especially found to be beneficial.

SUMMARY

The object of this invention being many fold may be best summarized as follows:

1. To reduce overall building energy costs by redistributing for use or rejection, waste heat from light fixtures with heat pipes.
2. To use a modified building sprinkler or separately installed circulation system as a means to redistribute or carry away heat.
3. To use a non-plumbing connection to the light fixture for thermal exchange and thereby eliminate wet connections of prior art devices and their inherent problems.

DRAWING DESCRIPTION

DETAILED DESCRIPTION

Figure 1:
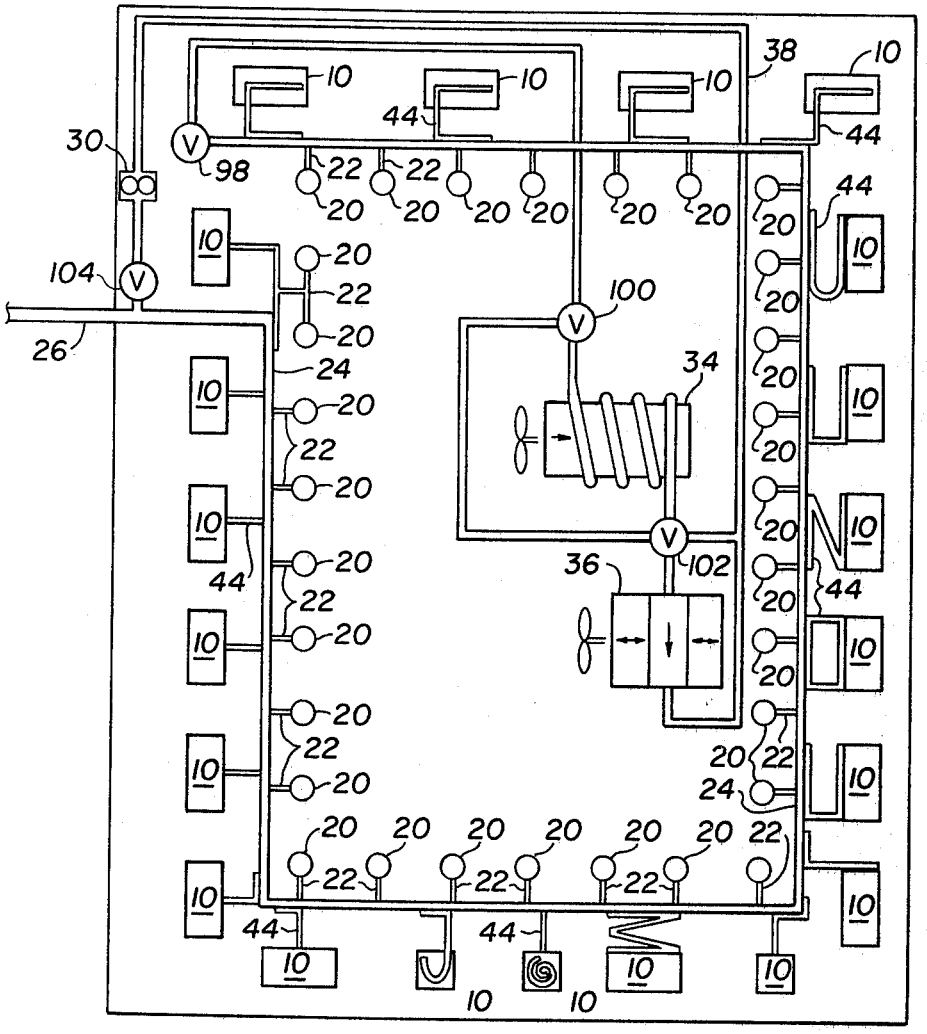
FIG. 1 is a schematic view of the room having light fixtures in ceiling panels having a sprinkler system as a means to take heat therefrom and utilize same in accordance with this invention.

With more particular reference to FIG. 1 there is shown thereby fluorescent light fixtures 10 mounted in a ceiling panel 12 (See FIG. 2) normally suspended by stringers and cable ties (not shown) from a ceiling 18 of a room in a building. In addition, emergency water sprinkler heads 20 are located to depend from panels 12 at periodic intervals, as in any fire sprinkler system. These heads 20 are fed via representative conduits 22 from conduit 24 within which in a normal emergency sprinkler system water is communicated from a source 26. The conduit 24 is normally suspended by straps (not shown) from the ceiling.

In practicing this invention it is desired to change the normal static emergency system to one of dynamic nature, i.e. a fluid flowing system. Therefore, a pump 30 is incorporated in line 24 to be driven by a motor (not shown) controlled by, for example a heat switch means (not shown), so as to circulate fluid from conduit 24 via a cooling tower 34 and/or a heat exchanger 36 of a common variety to a return line 38 such that the heat within the fluid may be rejected such as by a cooling tower or used to heat the building, for example, from ductwork that is conditioning the room via ceiling outlet as will be of familiar construction to one having knowledge of room heating and cooling systems including but not limited to one skilled in the art.

Representative heat pipes 44 are affixed by any means to provide a thermally conductive relationship to conduit 24. Such a heat pipe is represented by the teachings of U.S. Pat. Nos. 3,901,311 and/or 3,913,664 assigned to the common assignee herewith.

Figure 2:
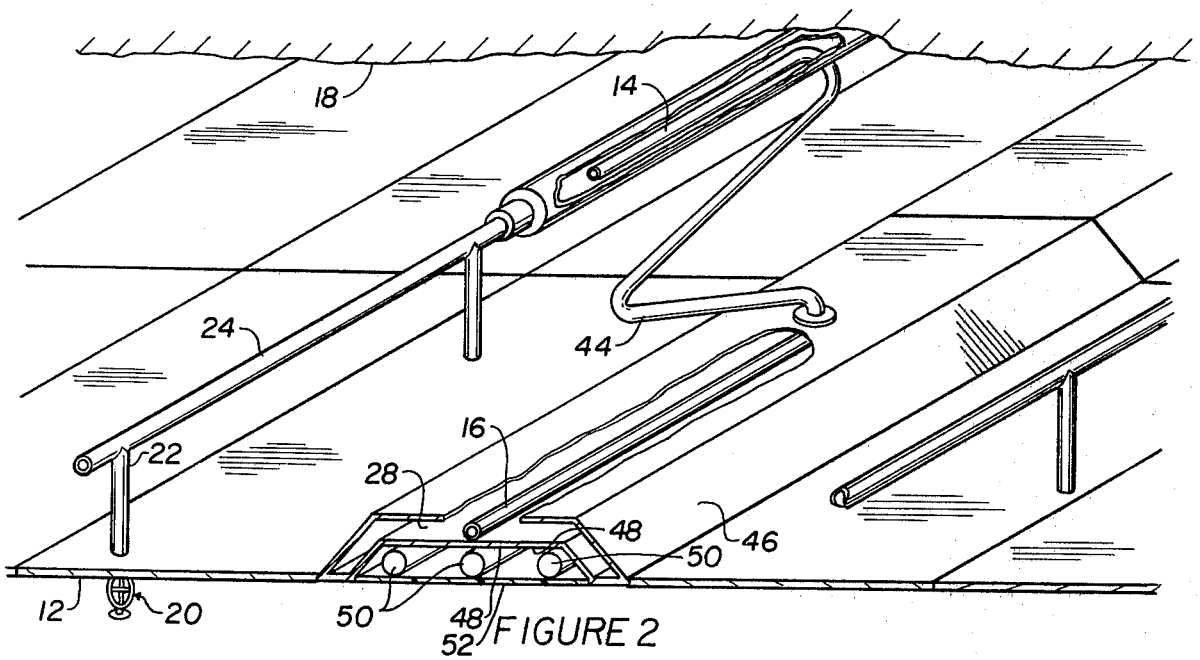
FIG. 2 is an isometric section of a light fixture in a ceiling panel with a heat pipe connection to the sprinkler system all in accordance with this invention.

A clearer representation of a preferred construction enabling use of heat from a light fixture is shown by FIG. 2. There the heat pipe 44 has an end 14 within the sprinkler conduit 24 and another end 16 within the chamber 28 between outer housing 46 and reflector panel 48 for the fluorescent tubes 50 within lens panel 52.

Figure 3:
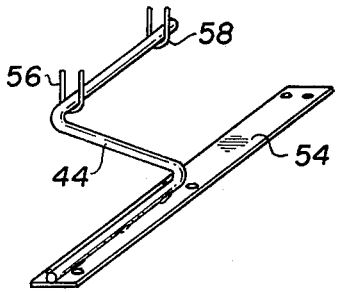
FIG. 3 is an isometric illustration of a dry connection flexible heat pipe assembly means.

An alternative to the submerged thermal connection is the dry connection shown in FIG. 3 where the heat pipe 44, again designed to permit flexing for installation tolerance forgiveness, etc., is shown to be joined by any thermally conductive bonding to a groove in a flat plate 54 that is adapted itself to be joined to a light fixture reflector, housing, etc. The other end of the heat pipe is shown to be mountable by "U"-bolts 56 and 58 to the sprinkler conduit 24.

Figure 4:
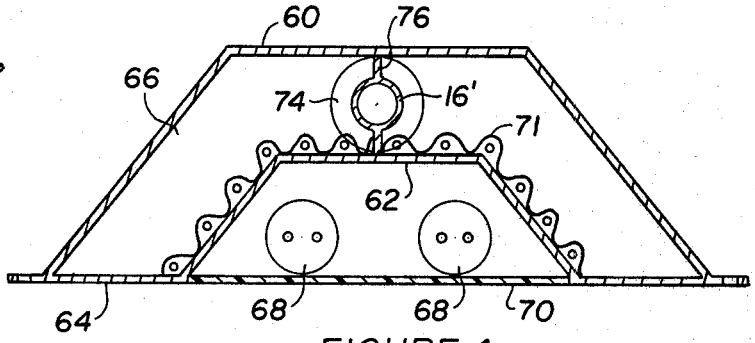
FIG. 4 is a cross-sectional view of a light dual wall, heat exchange chamber for a light fixture in accordance with this invention.

Still another design for this invention is depicted in FIG. 4. There the housing 60 has a reflector panel 62 thereunder joined by a panel 64 to form a sealed chamber 66 above fluorescent tubes 68. Lens 70 closes the light cavity.

Here the reflective panel is covered with a wicking 71 extending from heat pipe end 16', supported by means such as longitudinal fins 76 within chamber 66. Circular fins 74 may be used as shown by FIG. 4 to increase the heat transfer area for condensation of the heat pipe fluid.

Figure 5A:
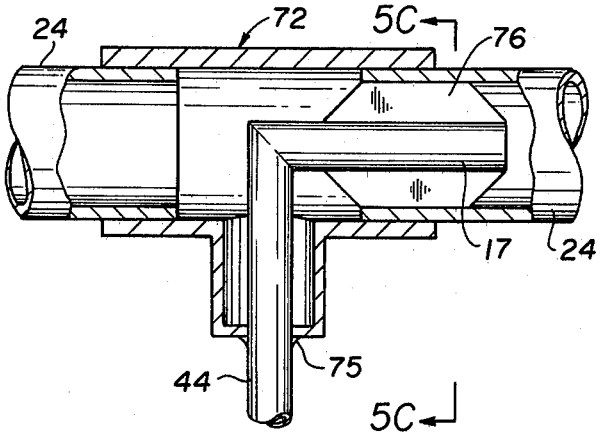
FIGS. 5A, 5B & 5C are cross sections of other possible heat exchange in fluid conduits and light fixtures.
Figure 5C:
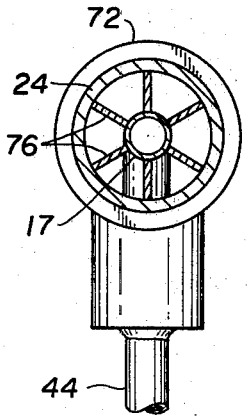

Still another construction of our invention is seen by FIGS. 5A & C. There a special "T" fitting 72 is mechanically coupled or soldered in conduit 24.

As seen, heat pipe 44 may be assembled within "T" fitting 72 and held as by solder connection 75.

Fins 76 not only support end 17 but create a flow pattern through the fitting 72 that will thoroughly wash the end 17. This is done while in no way interferring with the fire protection maximum water flow rate requirements.

Figure 5B:
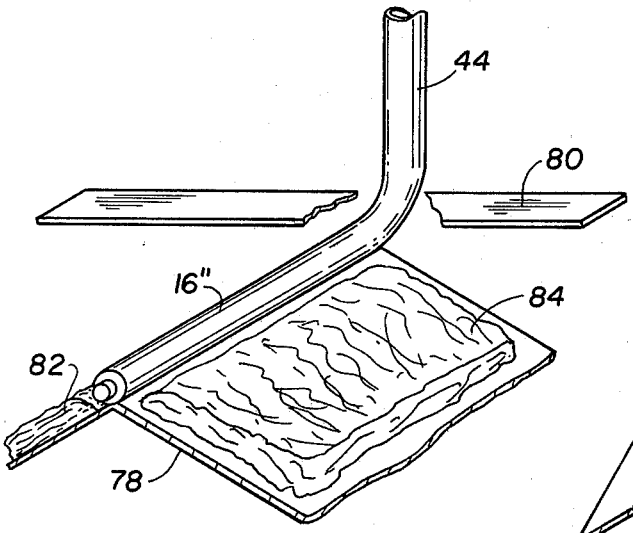

The other end 16'' of heat pipe 44 shown by FIG. 5B is bonded to reflector plate 78 at its apex under housing 80 similar to plate 62 and housing 60 of FIG. 4. In this structure the plate 78 has an angle downwardly from end 16'' so that the wicking surfaces 82 and 84 on either side of end 16'' have a natural gravity fall when housing 80 is installed in or to a ceiling.

Figure 6:
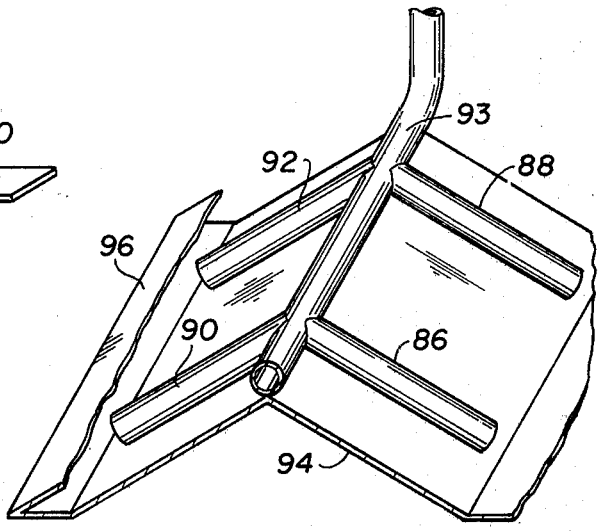
FIG. 6 is a broken isometric showing of a reflector housing for a light fixture showing a still further modification possible with this invention.

Fact of the matter is the reflector plate could be fabricated as shown in FIG. 6 so as to have a plurality of separate heat pipes 86, 88, 90, 92 radiating along surface 94 from a manifold 93 which would communicate each heat pipe to a part of the cooler sprinkling system or perhaps to still another heat pipe therefrom. Also the heat pipe may be a spiral on the reflector as shown by FIG. 1.

As may be readily appreciated by one skilled in the art this arrangement may also include a plurality of heat pipes 44 with individual "T" connections with pipe 24 for each light fixture. Each of these pipes could have ends 16'' extending in spaced relation on each side down inclined surfaces 78 in place of wicking surfaces 82 and 84 and instead of only longitudinal along the apex.

OPERATION

In operation the object with reference to FIG. 1 is to take heat from fixtures 10, transfer same to a circulating fluid in a fire sprinkler supply system manifolding conduit 24 and by the use of valves 98, 100, 102 and 104 control circulation to a cooling tower 34 to reject the heat to atmosphere or to heat exchanger 36 for utilization of the heat in the heating, ventilating and air conditioning (HVAC) system of the building or in maintenance of the system. More specifically when it is desired that the HVAC operate in a cooling mode the heat from fixture 10 is transmitted via normally open valve 98 and valve 100 to tower 34 and thence via valve 102 to conduit 38 and via normally open valve 104 back to pump 30. This removes heat locally and dumps to the outside air. Consequently the building's HVAC may be of smaller more economical design due to energy assist in removing heat of this invention. When, on-the-other-hand, it is desired that the aforesaid system operate in a heating mode to assist the HVAC, again normally open valve 98 permits circulation of the sprinkler system fluid having absorbed the heat of light fixtures 10 to valve 100 that this time is controlled to bypass tower 34 and feed heated fluid to valve 102 that is controlled to circulate same to heat exchange 36 where outside air to heat building is preheated to require less energy from the HVAC to raise building temperature. It will be readily understood that such a heat exchanger could be used to raise fluid temperature of any heating fluid system such as reheat systems employed by the HVAC. It is to be further understood that such heated fluid could be stored in a fluid storage tank during daytime hours for use in heating during the night when it may be needed more. The fluid from heat exchanger 36 then flows back via normally open valve 104 from the pump 30 to the sprinkler system. Typical circuitry to control valving and pumping will of course be provided as within the skill of the art. Such would only need to permit fluid circulation in bypass of HVAC units 34 and/or 36, through one or the other and system replenishment. In any event such circuitry as is needed forms no specific, separate part of this invention and further explanation is not therefore deemed necessary. Valves 98 and 104 can be operated to remove pump 30, tower 34 and heat exchanger 36 from the system while maintaining water in the sprinkler manifolding conduit 24.

With regard to the heat transfer from the light fixtures 10 it will be readily understood from the remaining figures in these Letters Patent that as the heat of the illuminated light means concentrates on the reflector surface 48, 62, 78 or 94 (FIGS. 2, 4, 5 and 6) heat will be transmitted or vapor will be generated from wicking surface 71, 82, 84 or within passages 86, 88, 90 and 92 that will rise to pipes 16, 16', 16'' or 93 where it will be condensed by contact therewith to fall back to wicking surfaces for redistribution by capillary action along the hotter reflector surface. The wicking is not really necessary as the fluid would be movable along the surface due to surface tension and/or gravity, but as one skilled in the art will readily recognize the wicking more evenly distributes the fluid along the hot surface from which heat is to be removed.

Similarly the pipes 44 and 93 are themselves heat pipes to transfer heat to sprinkler manifold 24 either by a dry connection or a wet connection, such as shown but not limited thereby. Any connection that eliminates line contact and provides a good thermal interface including flanged connections and saddle mating is possible without detracting from the objects of this invention.

Considering the structure and operation thereof aforedescribed one may better understand and employ total energy management in ones HVAC system in a building. Having that in mind it is now desired to set forth the protection sought by these Letters Patent in the appended claims.

We claim:

1. A system for removing heat from lighting fixtures and providing means to use or reject same in heating, ventilating and air conditioning devices for a building, said system comprising:

a means to take heat away from a light fixture;

a means to transfer the heat from the light fixture to a fire protection water sprinkler system; and a means to control the utilization or rejection of such heat in the building's heating, ventilating and air conditioning devices.

2. A system for removing heat from lighting fixtures and providing means to use or reject same in heating, ventilating and air conditioning devices for a building, said system comprising:

a means to take heat away from a light fixture;

a means to transfer the heat from the light fixture to a fire protection water sprinkler system;

a pump means to circulate the water through the water sprinkler system; and a means to control the utilization or rejection of such heat in the building's heating, ventilating and air conditioning devices.

3. A system for removing heat from lighting fixtures and providing means to use or reject same in heating, ventilating and air conditioning devices for a building, said system comprising:

a means to take heat away from a light fixture, said means being characterized as a heat pipe means;

a means to take the heat from the heat pipe means and transfer same to a fire protection water sprinkler system;

a pump means to circulate the water through the water sprinkler system;

heat exchange means in the water sprinkler system for the extraction of heat therefrom;

said heat exchange means including a cooling tower and a heater heat exchanger;

a means to control the circulation of the water to one or the other of the cooling tower or heat exchanger to employ same in conditioning the heating, ventilating and air conditioning devices.

4. A heat recovery means to utilize the heat of lighting in a heating, ventilating and air conditioning system for a building, said means comprising:

a plurality of light fixtures in the building;

a circulating water sprinkler fire protection system in the building;

heat pipe means connected between said light fixtures and said circulating water sprinkler system; and control means to valve water from the circulating water sprinkler system to various elements of the heating, ventilating and air conditioning system, said control means being valve means to control flow in the water sprinkler system and to a cooling and heating means of the heating, ventilating and air conditioning system.

* * * * *